US008540099B2

(12) United States Patent
Roush

(10) Patent No.: US 8,540,099 B2
(45) **Date of Patent: *Sep. 24, 2013**

(54) CONTAINER SIDEWALL CONNECTOR

(75) Inventor: Mark Roush, Lafayette, IN (US)

(73) Assignee: Vanguard National Trailer Corporation, Monon, IN (US)

( * ) Notice: Subject to any disclaimer, the term of this patent is extended or adjusted under 35 U.S.C. 154(b) by 7 days.

This patent is subject to a terminal disclaimer.

(21) Appl. No.: 13/312,380

(22) Filed: Dec. 6, 2011

(65) Prior Publication Data

US 2012/0234828 A1 Sep. 20, 2012

Related U.S. Application Data

(63) Continuation-in-part of application No. 13/049,106, filed on Mar. 16, 2011.

(51) Int. Cl.
*B65D 88/00* (2006.01)
*B65D 90/02* (2006.01)

(52) U.S. Cl.
USPC ..... 220/1.5; 296/186.1

(58) Field of Classification Search
USPC ..... 220/105, 652, 677, 680, 682, 685, 220/4.31, 4.33; 296/191, 186.1–186.5, 182.1, 296/203.01, 203.05; 52/592.1; 403/300, 403/331, 338
See application file for complete search history.

(56) References Cited

U.S. PATENT DOCUMENTS

| | | | | |
|---|---|---|---|---|
| 2,502,703 | A | 4/1950 | Chaplin | 296/186.1 |
| 3,028,192 | A * | 4/1962 | Jewell | 296/186.1 |
| 3,334,007 | A * | 8/1967 | Flagan | 428/166 |
| 3,880,460 | A * | 4/1975 | Pennock | 296/29 |
| 3,917,338 | A | 11/1975 | Becker | 410/116 |
| 4,810,027 | A | 3/1989 | Ehrlich | 296/186.1 |
| 5,058,756 | A | 10/1991 | Green | 220/1.5 |
| 5,112,099 | A | 5/1992 | Yurgevich | 296/186.1 |
| 5,185,193 | A * | 2/1993 | Phenicie et al. | 428/57 |
| 5,204,149 | A * | 4/1993 | Phenicie et al. | 428/57 |
| 5,439,266 | A | 8/1995 | Ehrlich | 296/186.1 |
| 5,584,252 | A | 12/1996 | Smith | 105/409 |
| 5,782,044 | A * | 7/1998 | Dodd et al. | 345/629 |
| 5,816,010 | A * | 10/1998 | Conn | 52/588.1 |
| 6,290,182 | B1 * | 9/2001 | Grunditz | 244/173.1 |
| 6,607,237 | B1 | 8/2003 | Graaff | 296/186.1 |
| 6,959,959 | B1 | 11/2005 | Roush | 296/186.1 |
| 7,011,358 | B2 | 3/2006 | Graaff | 296/186.1 |
| 7,134,820 | B2 | 11/2006 | Ehrlich | 410/150 |
| 7,500,713 | B2 | 3/2009 | Riley | 296/191 |
| 7,527,325 | B2 | 5/2009 | Yurgevich | 296/186.1 |
| 7,798,753 | B2 | 9/2010 | Yurgevich | 410/115 |
| 7,828,372 | B2 | 11/2010 | Ellison | 296/191 |
| 7,862,103 | B2 | 1/2011 | Riley | 296/186.1 |
| 8,016,527 | B2 | 9/2011 | Pattison | 410/115 |
| 2002/0101095 | A1 | 8/2002 | Gosselin | 296/186.1 |
| 2003/0080583 | A1 | 5/2003 | Jones | 296/186.1 |

(Continued)

*Primary Examiner* — Anthony Stashick
*Assistant Examiner* — Robert Stodola
(74) *Attorney, Agent, or Firm* — Taft Stettinius & Hollister LLP

(57) ABSTRACT

Presented is a composite panel container sidewall construction that provides additional interior logistics slots in the sidewalls of the container for securing cargo loaded into the container. The sidewall is constructed from posts, outer sheets, inner liners, and logistics panels. The outer sheets have inward protrusions that are secured into pockets in the posts. The logistic panels may include logistic slots that may be used to secure cargo or tie downs to the sidewall of the trailer.

20 Claims, 16 Drawing Sheets

(56) References Cited

U.S. PATENT DOCUMENTS

| | | | | |
|---|---|---|---|---|
| 2003/0080586 | A1 | 5/2003 | Ehrlich | 296/191 |
| 2004/0145215 | A1 | 7/2004 | Taguchi | 296/187.02 |
| 2004/0217625 | A1 | 11/2004 | Graaf | 296/186.1 |
| 2004/0232728 | A1 | 11/2004 | Smidler | 296/186.1 |
| 2006/0061136 | A1* | 3/2006 | Pines | 296/186.1 |
| 2006/0071507 | A1 | 4/2006 | Graaff | 296/186.1 |
| 2007/0200393 | A1 | 8/2007 | Riley | 296/191 |
| 2007/0290522 | A1* | 12/2007 | Graaff et al. | 296/186.1 |
| 2009/0146454 | A1 | 6/2009 | Riley | 296/186.1 |
| 2012/0234842 | A1* | 9/2012 | Roush | 220/660 |

* cited by examiner

CONTAINER SIDEWALL CONNECTOR

CROSS REFERENCE TO COPENDING APPLICATION

This application is a continuation-in-part of, and claims the benefit of, U.S. patent application Ser. No. 13/049,106 entitled "Container Sidewall Connector" by March Roush that was filed Mar. 16, 2011 the contents of which are herein incorporated by reference.

FIELD OF THE INVENTION

The present invention relates generally to a sidewall construction for a cargo container, and more particularly to a thin structural panel and post connector sidewall construction.

BACKGROUND OF THE INVENTION

Designers of cargo containers have long faced many related challenges in the design of container sidewalls. First, the structural integrity of the overall container depends on the rigidity and strength of the sidewalls. Second, the sidewalls are optimally light in weight to reduce the transportation costs for the overall container.

Third, government regulations or industry standards often limit the exterior dimensions of cargo containers. Thus, to maximize the capacity of the container, designers seek to minimize the width of the sidewalls without compromising the structural integrity of the container.

Fourth, because cargo containers are repeatedly loaded and unloaded, the interior walls of the container must be resistant to the repeated impact of vehicles and implements used to load and unload the container. Containers must optimally be free of protrusions and snag points that could impede loading and unloading. Fifth, means for securing and dividing cargo within a container are often desirable, and may be provided by incorporating logistics slots in the sidewalls of the container. Sixth, even resilient sidewalls may become damaged with extended use and require replacement or repair, Seventh, installing bolts or rivets commonly used in assembling sidewalls increases the container construction time, sidewall thickness, and the cost of the container. Eighth, various thicknesses of panels are used in container construction based on the desired characteristics of the container. Connectors between panels must be adaptable to these various thicknesses. Other considerations, including the cost and availability of the sidewall components and the ease of manufacturing, are also important.

These challenges are particularly acute in the design and construction of sidewalls for over-the-road trailers. Structural integrity for trailers is of course essential to the safe transportation of goods and materials on public highways. This structural integrity has conventionally been provided by either a "sheet and post" or a structural panel sidewall construction.

In sheet and post sidewall construction, vertical posts are used to provide the primary structural integrity for the trailer. Such posts are typically formed by bending or roll forming galvanized steel or extruding aluminum into non-linear shapes, thus providing rigidity and strength for the post. Relatively thin and easily replaceable sidewall sheets, typically made of plywood or plastic, are attached to the vertical posts in the interior of the trailer and a protective outer skin is attached to the exterior of the trailer. A protective metal, wood, or plastic liner may also be provided at the base of the interior sidewall to protect the sheets and posts from being damaged or pierced by vehicles loading and unloading the trailer. This sheet and post design offers certain advantages, including high structural strength attributable to the vertical posts, lower cost and ease of manufacturing, among others. Also, although the thin interior sheets are susceptible to damage, these sheets are relatively inexpensive and easy to replace. Conventional sheet and post designs, however, suffer from a key disadvantage, namely, the thickness of the posts required to provide structural integrity for the trailer.

Structural panel sidewalls have also been used in the construction of over-the-road trailers to address many of the challenges related to cargo containers. In particular, because of the strength and rigidity of the structural panels, sidewall thickness can generally be reduced as compared to conventional sheet and post designs. The structural panels are typically joined at their edges with vertical splicer plates on the inside and outside of the trailer, as shown in U.S. Pat. No. 4,904,017 (FIG. 9) issued to Ehrlich, U.S. Pat. No. 5,860,693 (FIG. 2) issued to Ehrlich and U.S. Pat. No. 6,450,564 (FIG. 3) and U.S. Pat. No. 6,578,902 (FIGS. 4 and 5) issued to Sill. The structural panels may also be joined with vertical posts on the inside and outside of the trailer, as disclosed in the applicant's U.S. Pat. No. 7,152,912 and incorporated herein by reference. These vertical posts are typically provided with logistics slots for securing and dividing cargo within the trailer.

Structural panels are often composite panels made of a core plastic material and an outer skin of aluminum or steel. The metal skin of the panels is resistant to damage when the cargo is loaded and unloaded, and because of the strength and rigidity of the composite panels, trailer sidewall thickness can generally be reduced as compared to sheet and post designs. Although lighter in weight than solid aluminum panels, composite panels are typically more expensive than the materials used in conventional sheet and post designs. Additionally, structural panel sidewalls are difficult and expensive to replace if a single panel becomes damaged.

The use of rivets to connect structural panels to posts or plates often increases the thickness of the sidewall, and also increases the number of snag points inside the container. Additionally, the use of rivets increases the number of parts used in constructing the container which can increase the cost and time to manufacture a cargo container.

Some of the advantages of a rivetless cargo container sidewall that combines the thin cross-section of structural panel sidewalls with the easily replaceable interior panels of a sheet and post configuration have been recognized.

U.S. Pat. No. 5,584,527 issued to Sitter discloses a "plate-type" trailer with a rivetless and boltless sidewall construction. This configuration includes corrugated panels and "seam extrusion members" that connect the corrugated panels. The corrugation of the paneling in the '527 patent decreases the total available space inside the trailer, and the connectors make panel replacement difficult. Thus, the need remains for a rivetless and boltless sidewall construction that allows for easy replacement of damaged panels.

U.S. Pat. No. 5,403,062 issued to Sjostedt discloses a "panel joint" trailer with a rivetless and boltless sidewall construction. This configuration includes modular panels with integral protrusions, tapered end sections, and adhesive to join the tapered end section of one panel to the integral protrusion section of another panel. The panels disclosed by the '062 patent are highly interconnected, and therefore not easily replaceable.

U.S. Pat. Nos. 5,860,693, 6,220,651, 6,412,854, 6,986,546, and 7,069,702 issued to Ehrlich disclose a structural panel joint configuration. This configuration includes a pair of panels and two metal plates connected by rivets. However, the panels are not easily replaceable due to the use of rivets.

Accordingly, an object of the present invention is to provide a sidewall construction for a cargo container that is lightweight yet rigid and strong.

A further object of the present invention is to provide a cargo container with thin sidewalls to maximize the capacity of the container.

Another object of the present invention is to provide a sidewall construction that does not require the use of bolts or rivets.

Yet another object of the present invention is to provide a cargo container with interior walls resistant to the impact of vehicles and implements used to load and unload the container, and to provide a cargo container with minimal protrusions and snag points that could impede the loading or unloading of the container.

An additional object of the present invention is to provide a cargo container sidewall with panels that can be easily removed and replaced in the event they become damaged.

A still further object of the present invention is to provide a cargo container with interior logistics slots in the container sidewalls for securing cargo.

Finally, an object of the present invention is to provide a cargo container sidewall configuration that that is economical to manufacture and refined in appearance.

SUMMARY OF THE INVENTION

An improved panel and connector sidewall construction is presented. While maintaining the benefits of standard structural panel designs, the post connector construction also achieves many benefits of traditional sheet and post designs, including simplified replacement of damaged interior panels. The design also allows for simplified replacement of the outer panels of the container while simultaneously providing an aerodynamic surface without protruding rivets. The sidewall construction also achieves the important objective of providing smooth trailer walls with minimal recesses, protrusions and snag points.

The composite panel container sidewall construction provides additional interior logistics slots in the sidewalls of the container for securing cargo loaded into the container. These additional interior logistics slots are provided by a vertical support that is seated in the post to avoid creating snag points on the interior of the trailer. The sidewall construction also achieves the benefits of conventional composite panel designs, including the recognized benefit of thin container sidewalls that provide an overall interior trailer width of at least 101 inches.

These and other advantages will become apparent as this specification is read in conjunction with the accompanying drawings and claims.

DETAILED DESCRIPTION

The sidewall construction may be used with any type of transportable cargo container and is particularly suited for applications requiring a large, lightweight container that is regularly loaded and unloaded by utility vehicles. The improved sidewall construction may be used with containers transported by road, rail, sea, or air. However, for descriptive purposes, the sidewall construction will be described in use with an over-the-road trailer.

Figure 1:
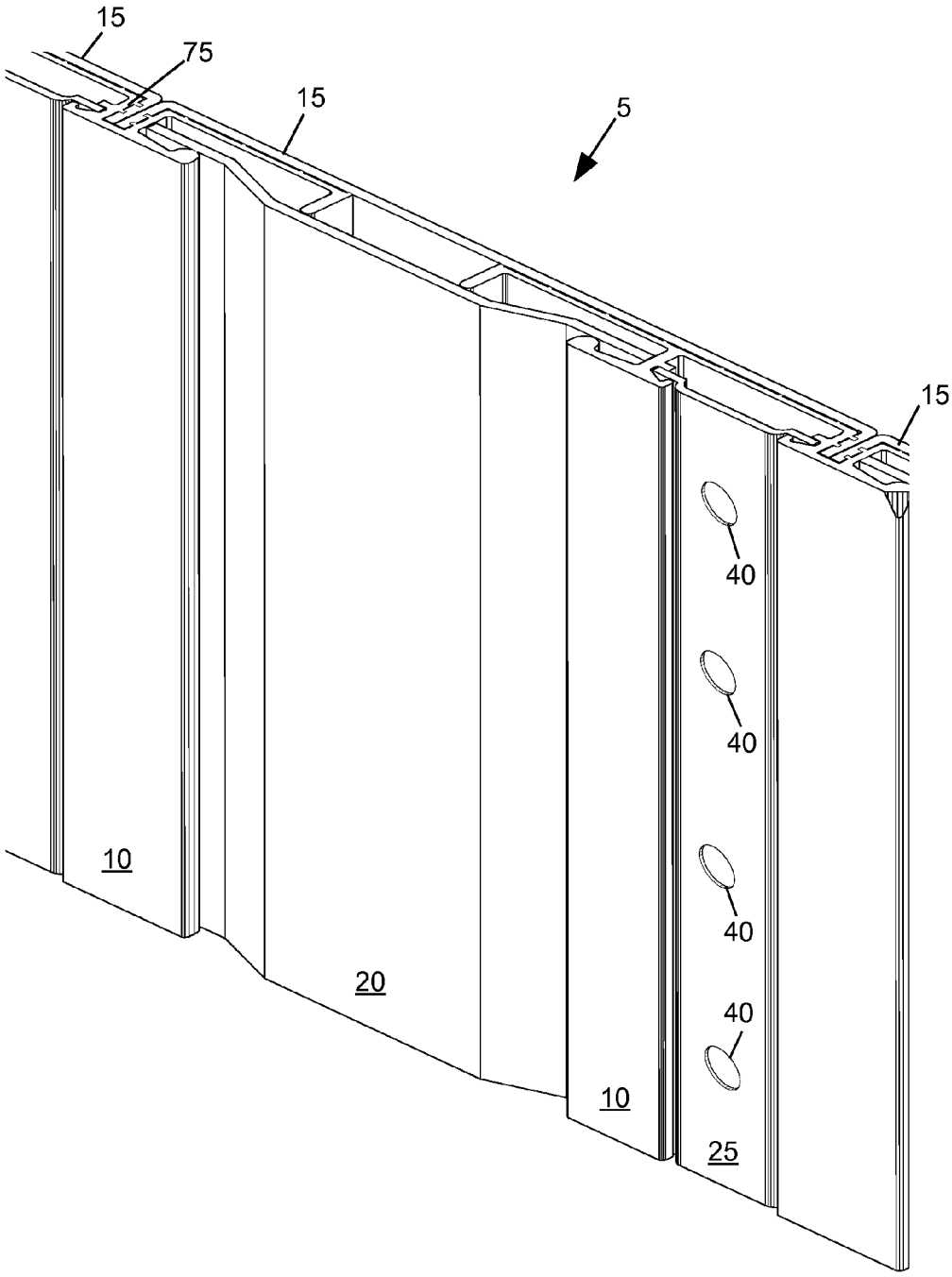
FIG. 1 is a perspective view of a sidewall with logistics slots, outer sheets and inner liners connecting to posts.

FIG. 1 shows a side perspective view of a sidewall 5 constructed from posts 10, outer sheets 15 or exterior panels, inner liners 20 or removable panels and logistics panels 25. The outer sheets 15 have inward protrusions 30 that are secured into pockets 75 in the posts. The logistic panels 25 include logistic slots 40 that may be used to secure cargo or tie downs to the sidewall of the trailer. The sidewall may be used in a cargo container having an interior for the storage and transport of cargo, a floor 54, and the sidewall construction extending upwardly from the floor to bound a cargo storage space.

The inner liners 20 are preferably constructed of recycled or virgin polyethylene, and thus are flexible and resilient upon impact. The flexibility of the liners 20 enables them to be bent slightly and inserted into the posts 10 after the posts are secured in place. However, the liners 20 may also be slid into place from the top of the posts 10, or placed in position when the posts 10 are secured in place. Although resistant to damage, the liners 20 may be easily removed for replacement in the event that the liners do become damaged.

Figure 2:
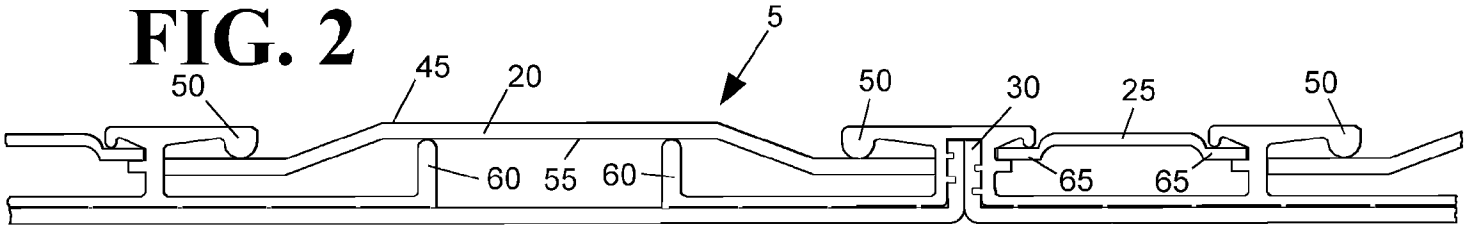
FIG. 2 is a top view of a sidewall with logistics slots, outer sheets and inner liners connecting to posts.
Figure 3:
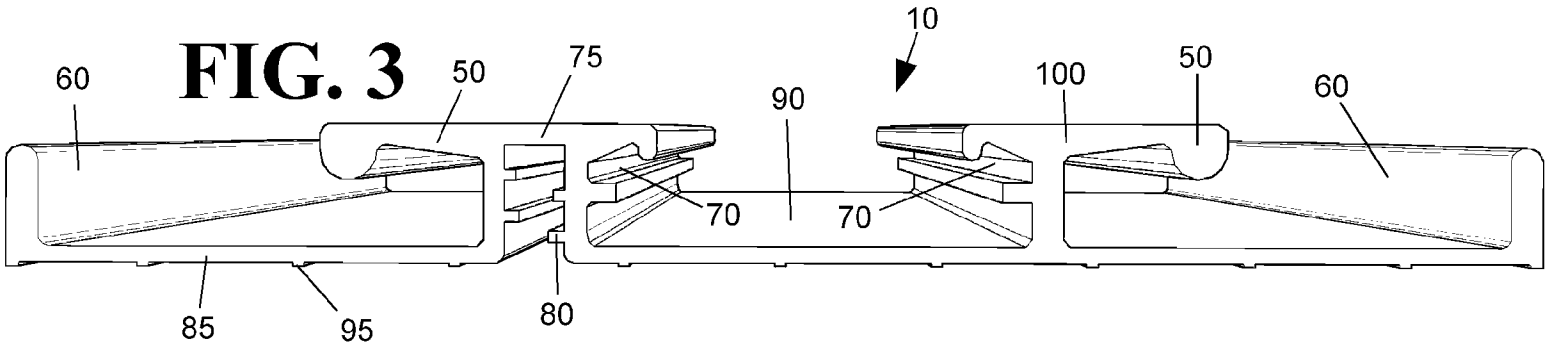
FIG. 3 is a top perspective view of a sidewall with logistics slots, outer sheets and inner liners connecting to posts.
Figure 4:
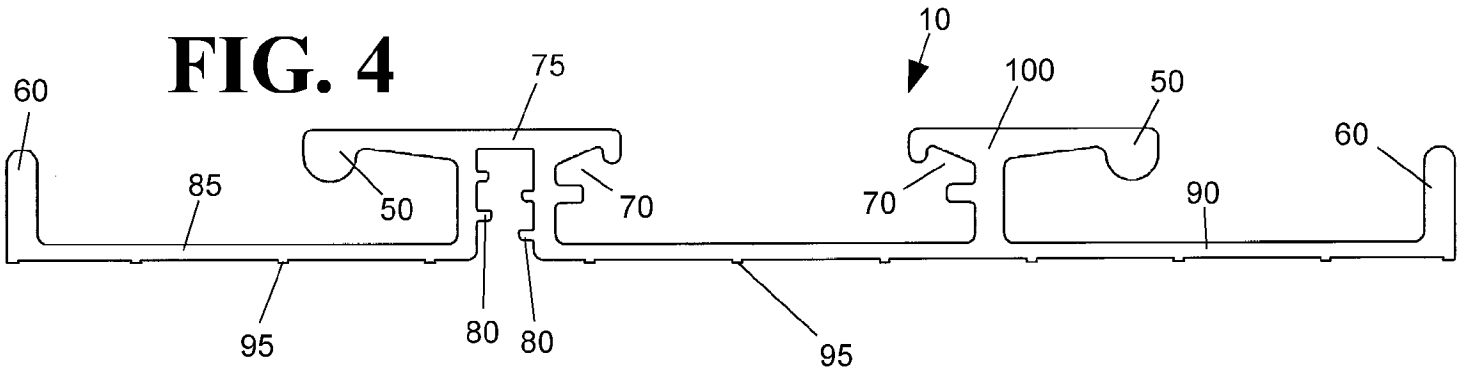
FIG. 4 is a top view of a post.
Figure 5:
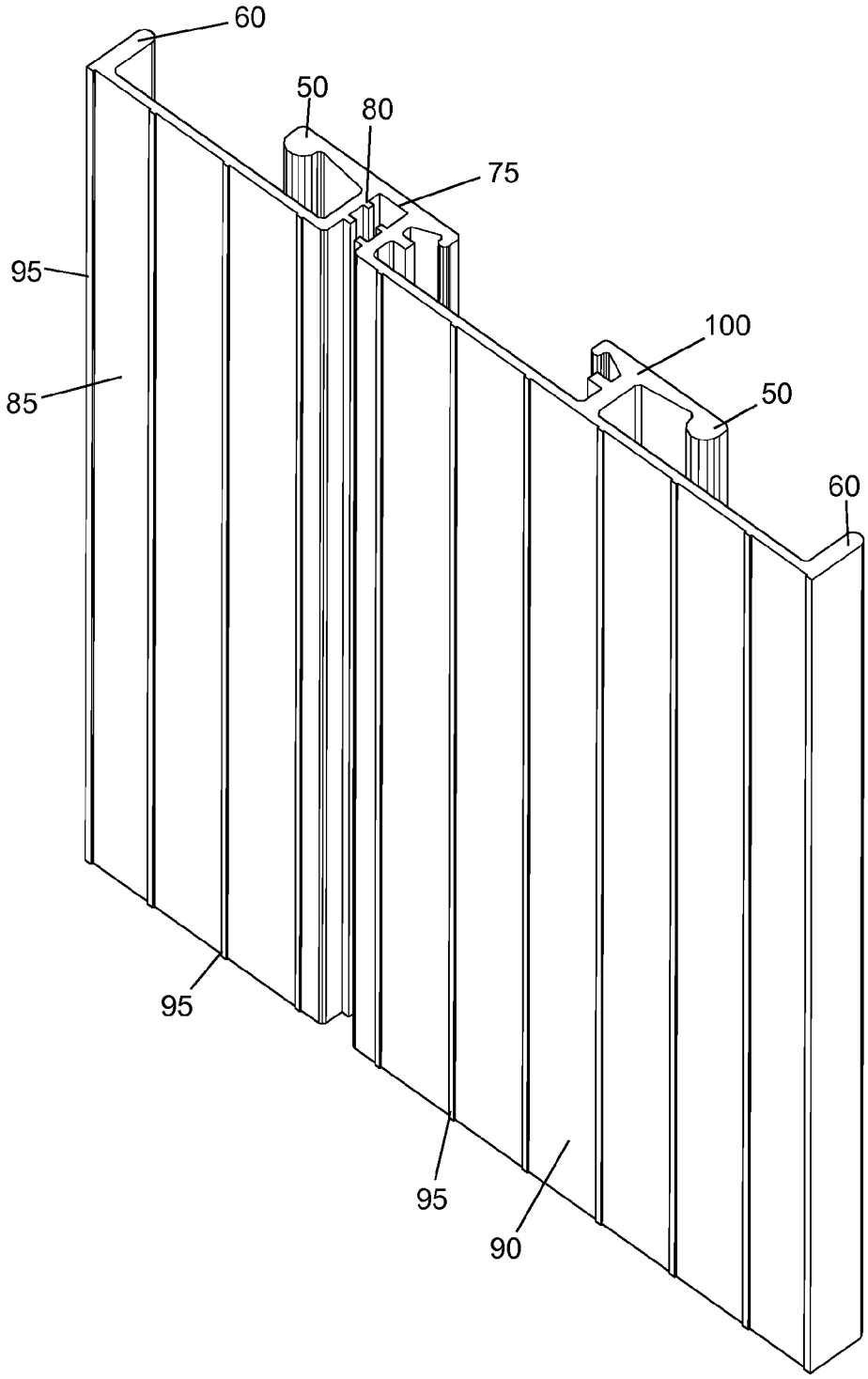
FIG. 5 is an outer perspective view of a post.
Figure 6:
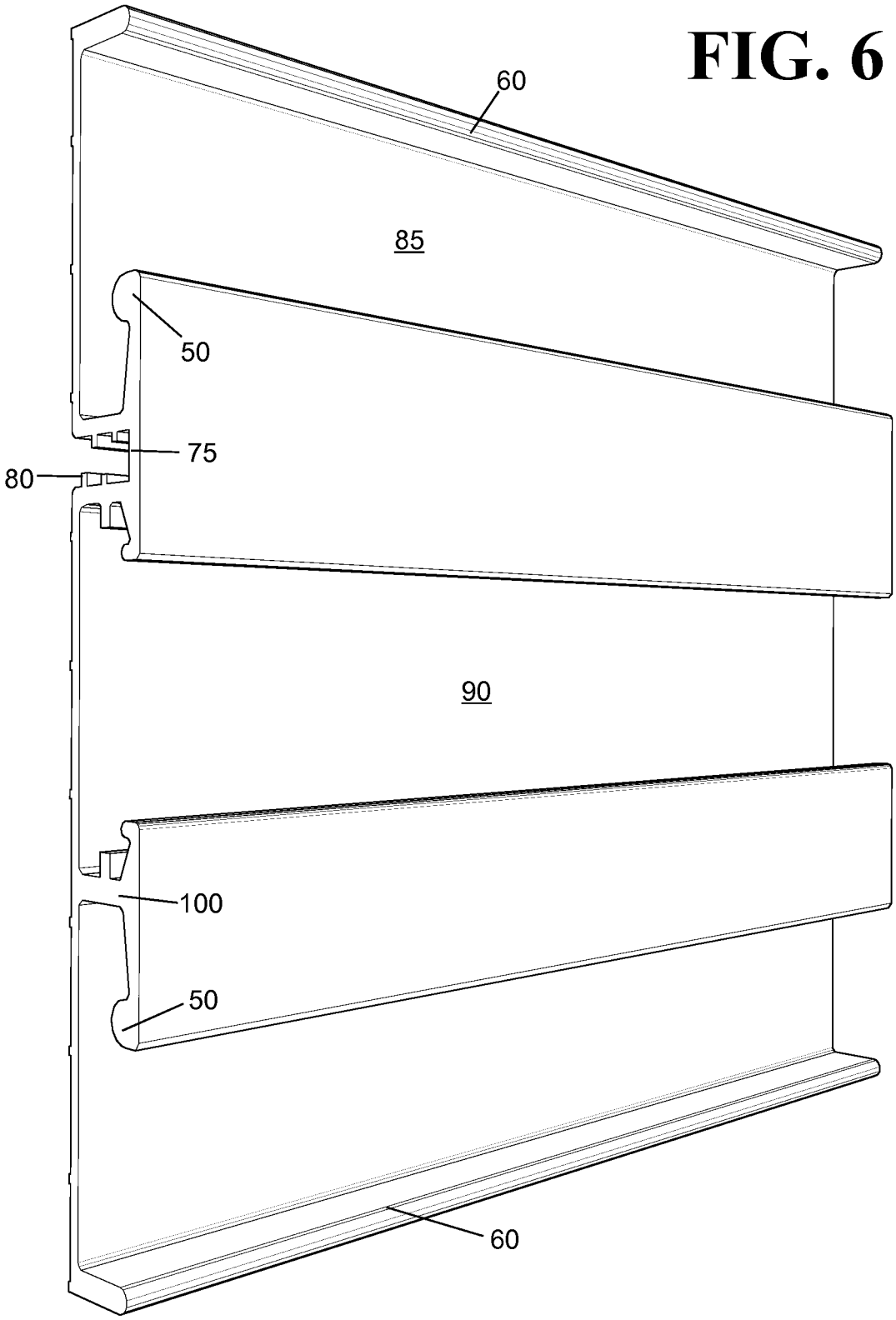
FIG. 6 is an inner perspective view of a post.
Figure 7:
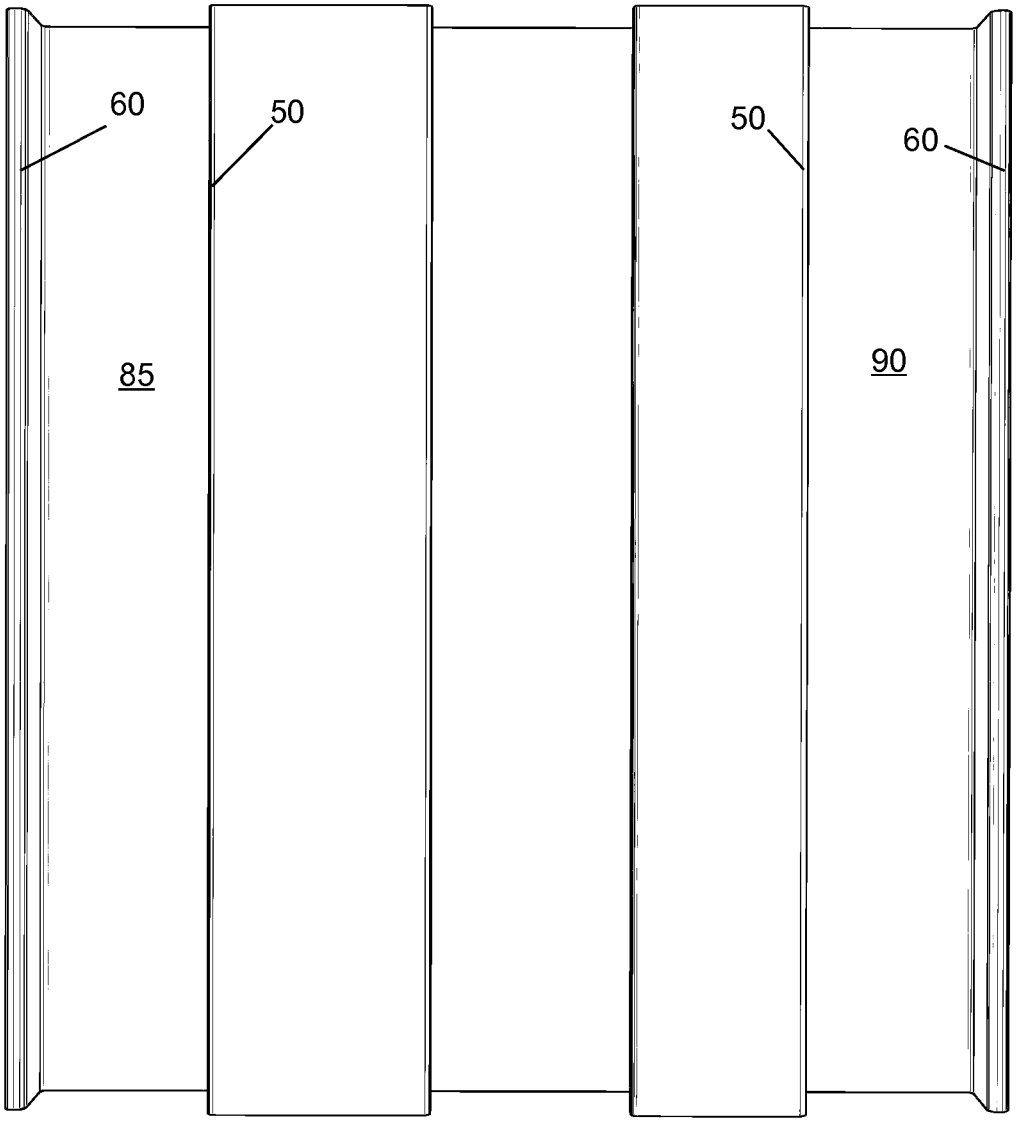
FIG. 7 is a front view of a post.
Figure 8:
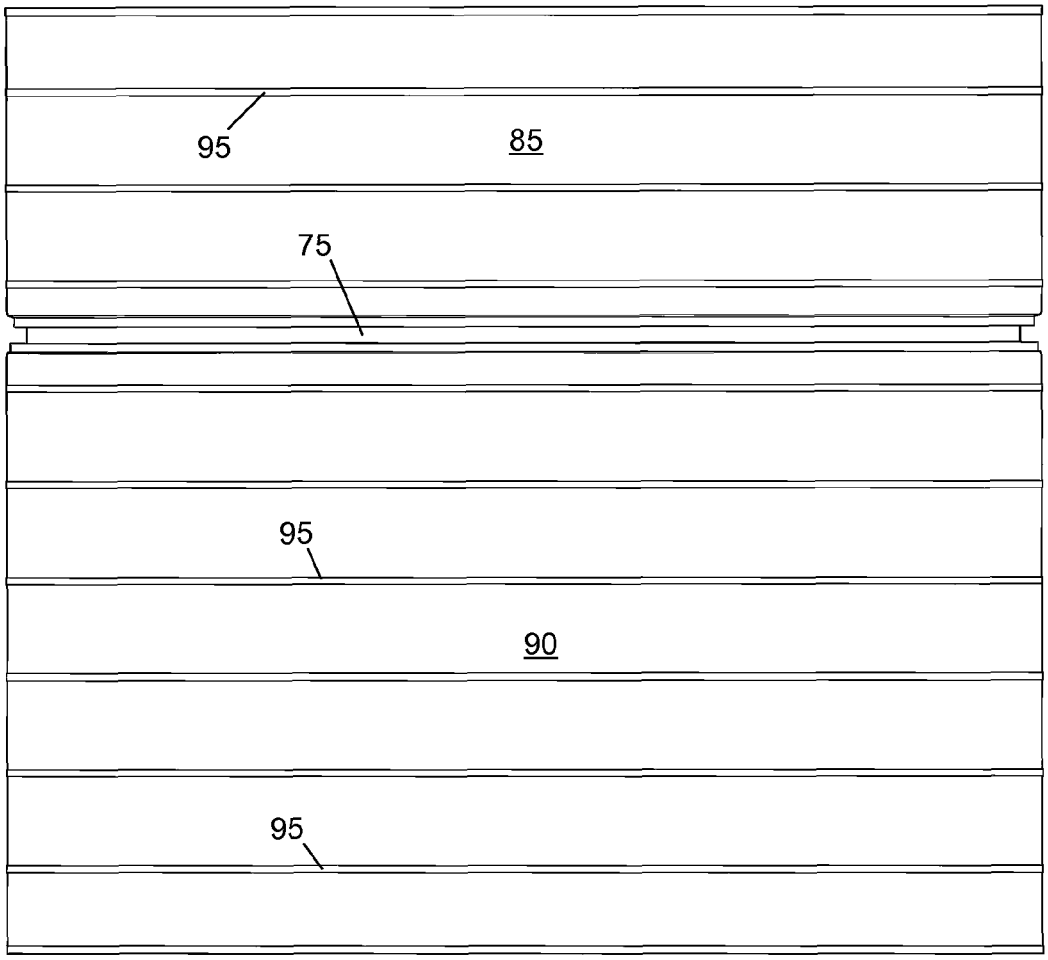
FIG. 8 is a rear view of a post.

As shown in FIG. 2, the liner 20 is held securely in place because the inner surface 45 of the liner 20 is pressed against a lateral protrusion 50 of the post 10. The outer surface 55 of the liner 20 is pressed against inward protrusions 60 of the posts 10. Because the liner 20 is held securely in place by the novel configuration of the post 10, rivets or screws are not needed to attach the liner to the post. Thus, unlike conventional sheet and post designs, potential protrusions and snag points are eliminated.

The logistic panels 25 have lateral wings 65 that seat in the logistics seat 70 of the post 10. The logistic panels 25 are preferably made of a rigid material such as metal so they are slid into place from the top of the posts 10, or placed in position when the posts are secured in place. However, flexible logistic panels may be bent into position in a manner similar to the liners. Since flexible logistic panels may not be appropriate for securing cargo to the sidewall, the flexible panels are preferably used when logistic slots are not needed. Alternatively, a sidewall may be constructed with a mix of lightweight plastic logistic panels and rigid metal logistic panels when a full compliment of tie down locations is not needed and the weight of the sidewall is to minimized.

FIGS. 3 through 8 show views of a post 10. The post 10 has a pocket 75 for receiving and securing inward protrusions of the outer sheets. Inside of the pocket 75 there are multiple ridges 80 that act to mechanically secure the outer sheets to the post. Adhesive may also be used to secure the outer sheets to the pocket. Laterally extending from the pocket are a first wall 85 and a second wall 90 that run adjacent to the outer sheets. In the illustrated example of FIGS. 3 and 4, the walls (85 and 90) extend to the inward protrusions 60 of the post. However, the walls may extend beyond the inward protrusions, such as shown in FIGS. 9, 10, 12 and 13. Small outward protrusions 95 extend from the walls toward the outer sheets. Adhesive may be placed between the small outward protrusions to help secure the post to the outer sheets. A lateral protrusion 50 extends away from the pocket 75 towards one of the inward protrusions 60 and is structured to press against and secure the inner surface of a liner.

Extending inward from the second wall 90 between an inward protrusion 60 and the pocket is an inward projection 100 that forms part of the logistics seat 70. A lateral protrusion 50 also extends away from the inward projection 100. Both lateral protrusions 50 act to secure the inner surface of a liner.

Figure 9:
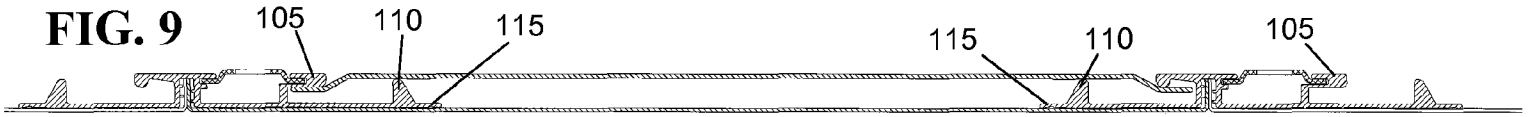
FIG. 9 is a top view of a second embodiment of a sidewall.
Figure 10:
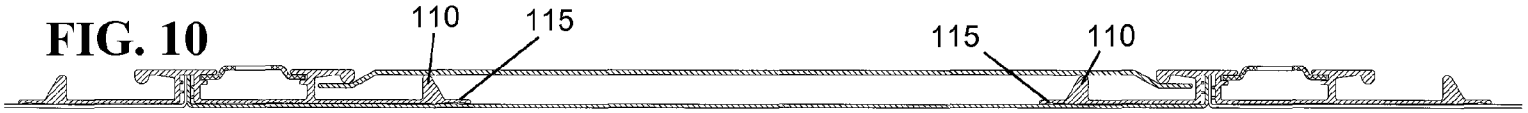
FIG. 10 is a top view of a third embodiment of a sidewall.
Figure 12:
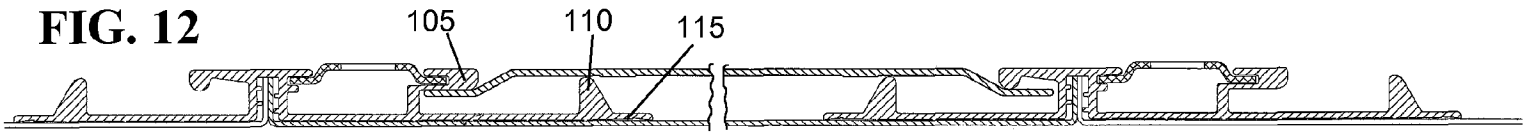
FIG. 12 is a compressed top view of the second embodiment of the sidewall.
Figure 13:
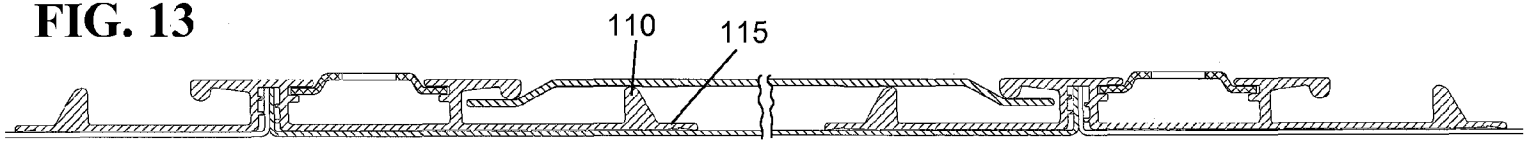
FIG. 13 is a compressed top view of the third embodiment of the sidewall.

FIGS. 9 and 12 illustrate a second embodiment of a sheet and post side wall. In the sidewall shown in FIGS. 9 and 12, the post has a combined logistics seat 105 that acts as both the logistics seat for the logistics panel and the lateral protrusion for securing the inner liner. Also, the post has rounded inward protrusions 110 and wall extensions 115. The larger rounded protrusions may help to prevent the liner from cracking or breaking if the sidewall is impacted from within the cargo container. The wall extensions 115 provide additional surface area for adhesively securing the outer sheets to the post. FIGS. 10 and 13 illustrate the third embodiment of the sidewall with rounded inward protrusions 110 but lacking the combined lateral protrusion and logistics seat.

Figure 11:
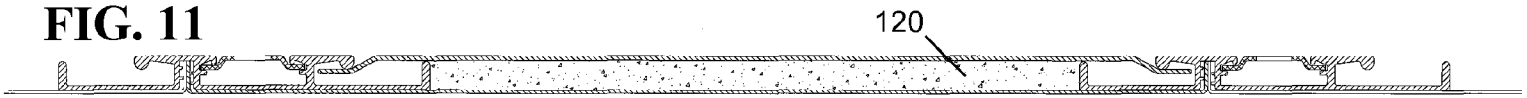
FIG. 11 is a top view of a fourth embodiment of a sidewall used for refrigerated trailers.
Figure 14:
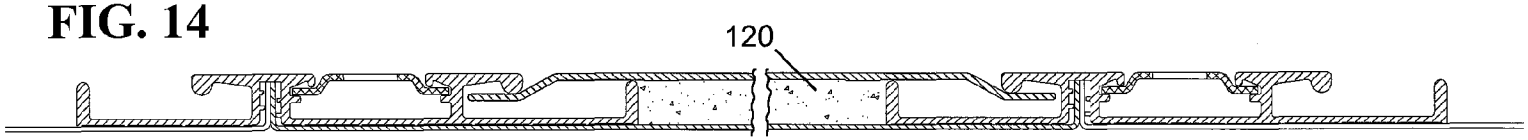
FIG. 14 is a compressed top view of the fourth embodiment of the sidewall.

FIGS. 11 and 14 illustrate an embodiment of a sidewall construction where insulation 120 has been applied between the outer sheets and the inner liner. The insulated sidewall construction is particularly well suited for refrigerated trailers.

Figure 15:
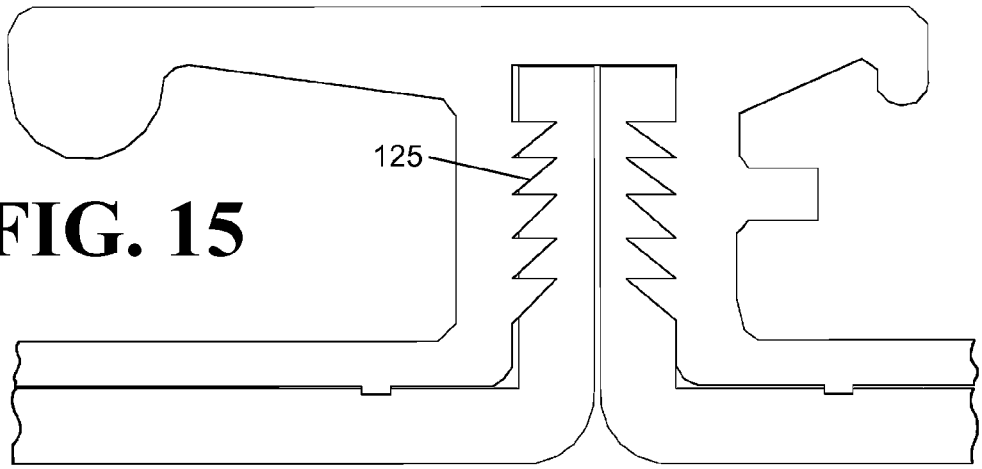
FIG. 15 is a side view of a post with ratcheting grooves securing outer sheets.
Figure 16:
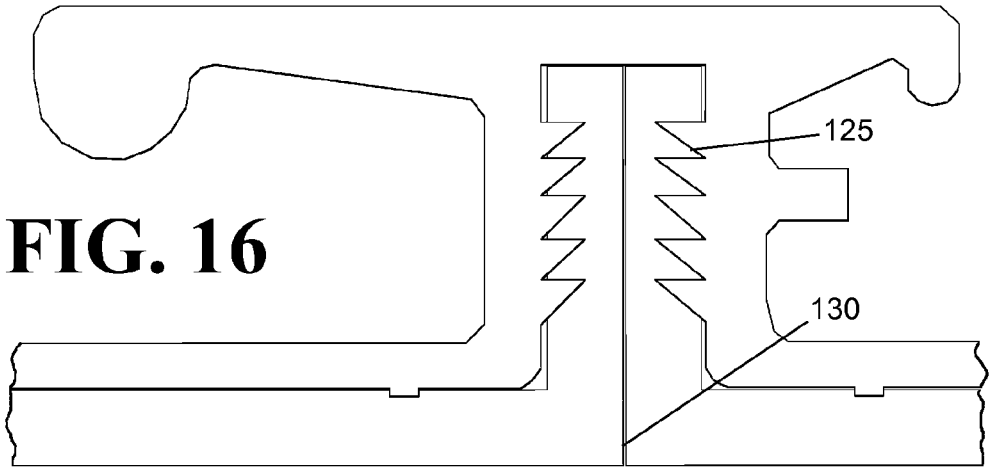
FIG. 16 is a side view of a post with ratcheting grooves securing outer sheets with flush rectangular edges.
Figure 17:
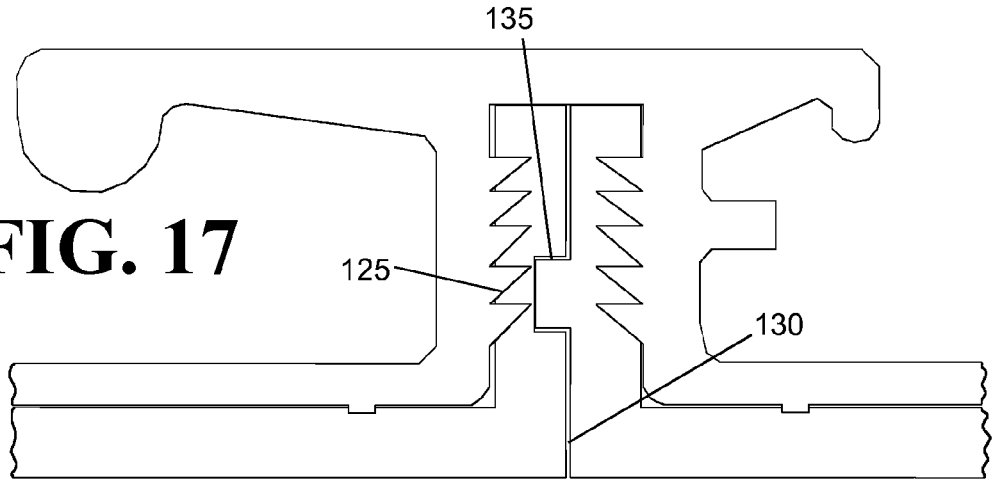
FIG. 17 is a side view of a post having ratcheting grooves securing interlocking outer sheets with flush rectangular edges.
Figure 18:
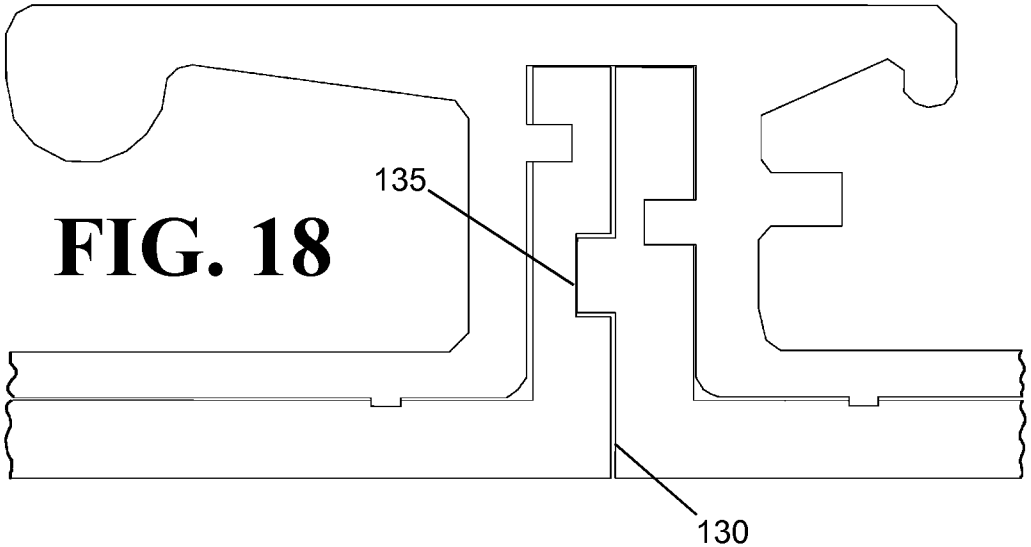
FIG. 18 is a side view of a post securing interlocking outer sheets with flush rectangular edges.

FIG. 15 illustrates an example of a pocket that has ratcheting grooves 125 that facilitate easy entry of the outer sheets into the pocket while also securely holding the sheets in the pocket. FIG. 16 shows outer sheets with rectangular edges 130. The rectangular edges provide a smooth aerodynamic outer surface for a trailer. FIG. 17 shows sheets with interlocking features 135 that not only secure the outer sheets to the post, but also to themselves. FIG. 18 shows another combination of sheets with rectangular edges 130 and interlocking features 135 without the ratcheting grooves of FIGS. 15 through 17.

Figure 19:
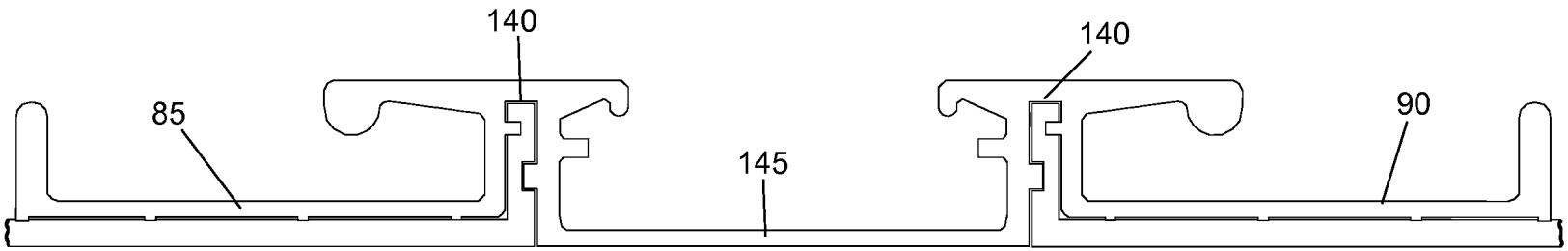
FIG. 19 is a side view of a post having separate pockets individually securing outer sheets.
Figure 20:
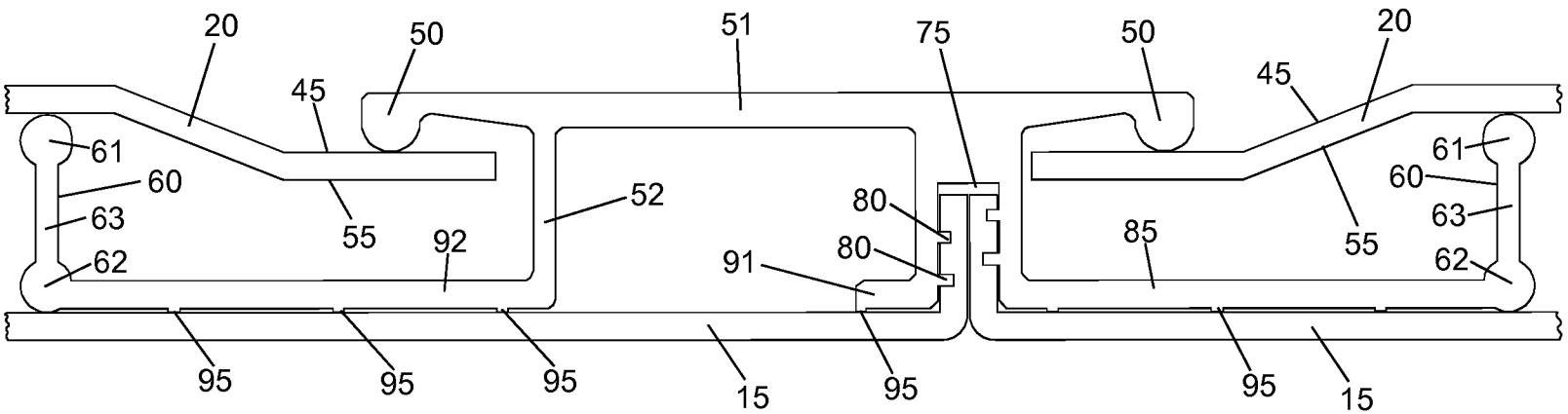
FIG. 20 is a top view of a post having a logistic span.
Figure 21:
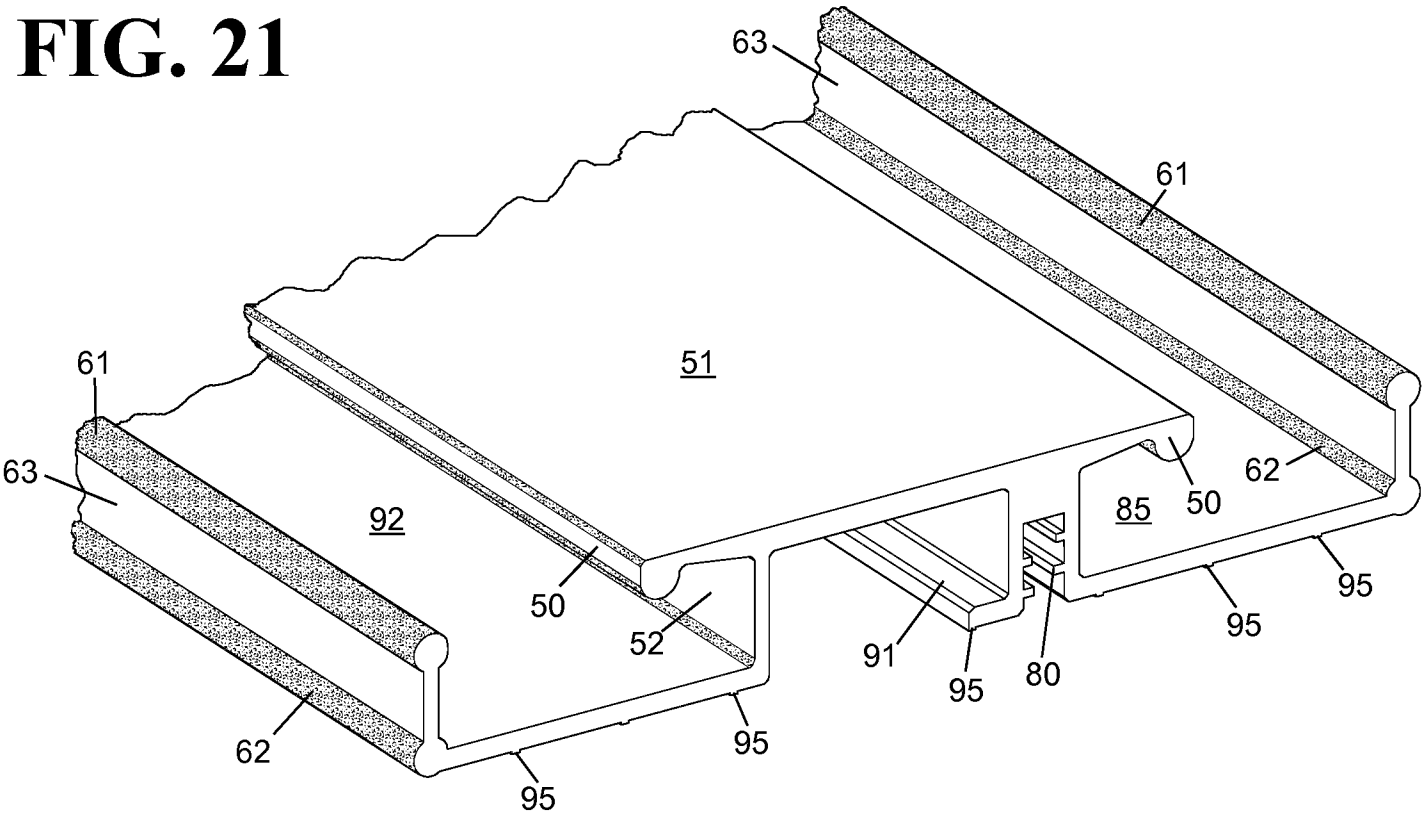
FIG. 21 is an upper perspective view of a post having a logistic span.
Figure 22:
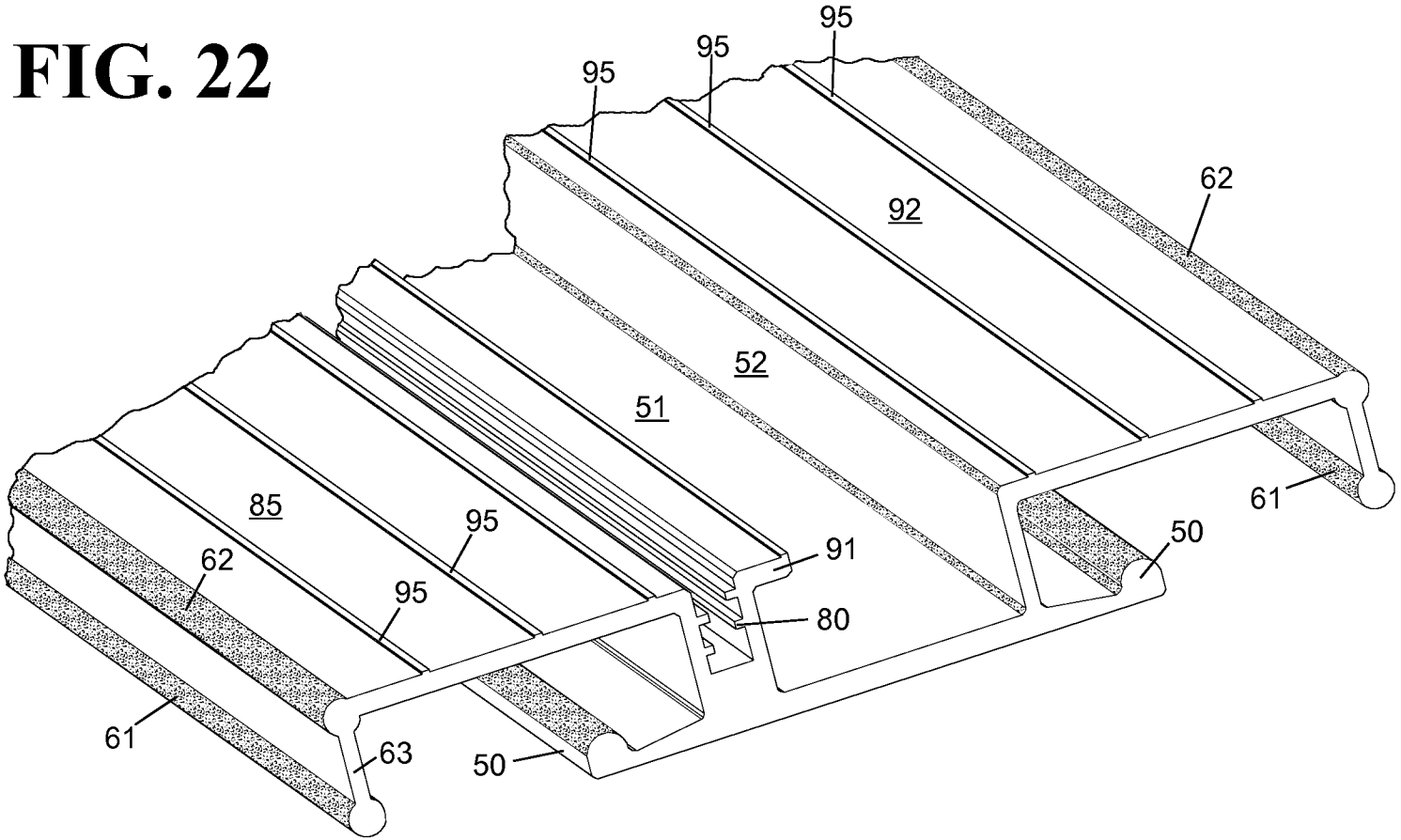
FIG. 22 is a lower perspective view of a post having a logistic span.

FIG. 19 illustrates an alternate embodiment of a post having dual pockets 140 that separately receive outer sheets. The first wall 85 and the second wall 90 of the post are separated by a center wall 145. The center wall 145 extends beyond the first and second walls so that the outer surface of the sidewall construction is relatively smooth.

FIGS. 20 through 23 illustrate an alternate embodiment of a container side wall constructed from outer sheets 15, inner liners 20, and a post. The inner surfaces 45 of the liners are pressed against two later protrusions 50 on the post while the outer surfaces 55 of the liners 20 are pressed against inward protrusions 60 on the post. A logistics span 51 or interior wall extends between the two lateral protrusions 50 of the post of FIG. 20.

Figure 23:
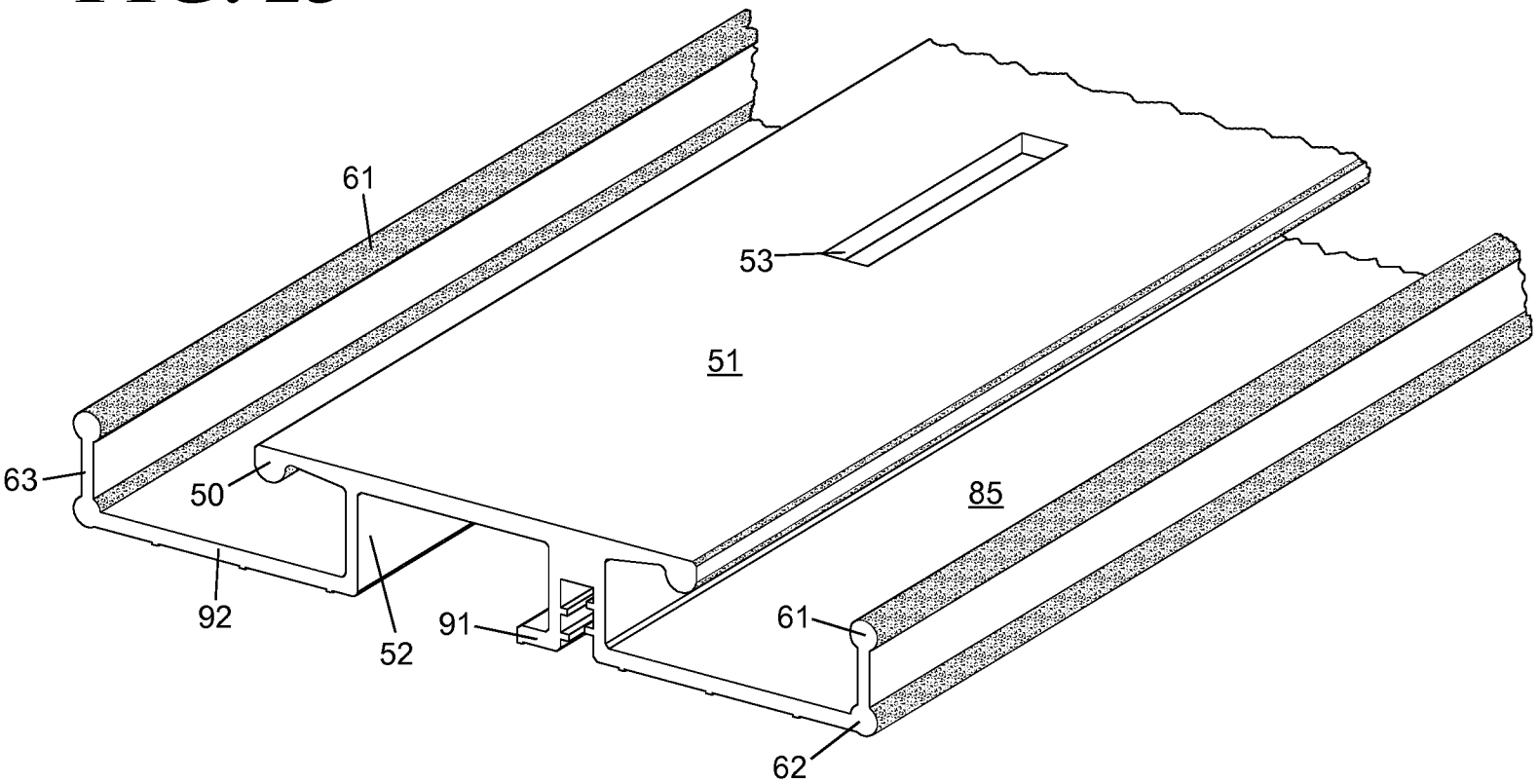
FIG. 23 is an upper perspective view of a post having a logistic span and a logistic slot in the logistic span.
Figure 24:
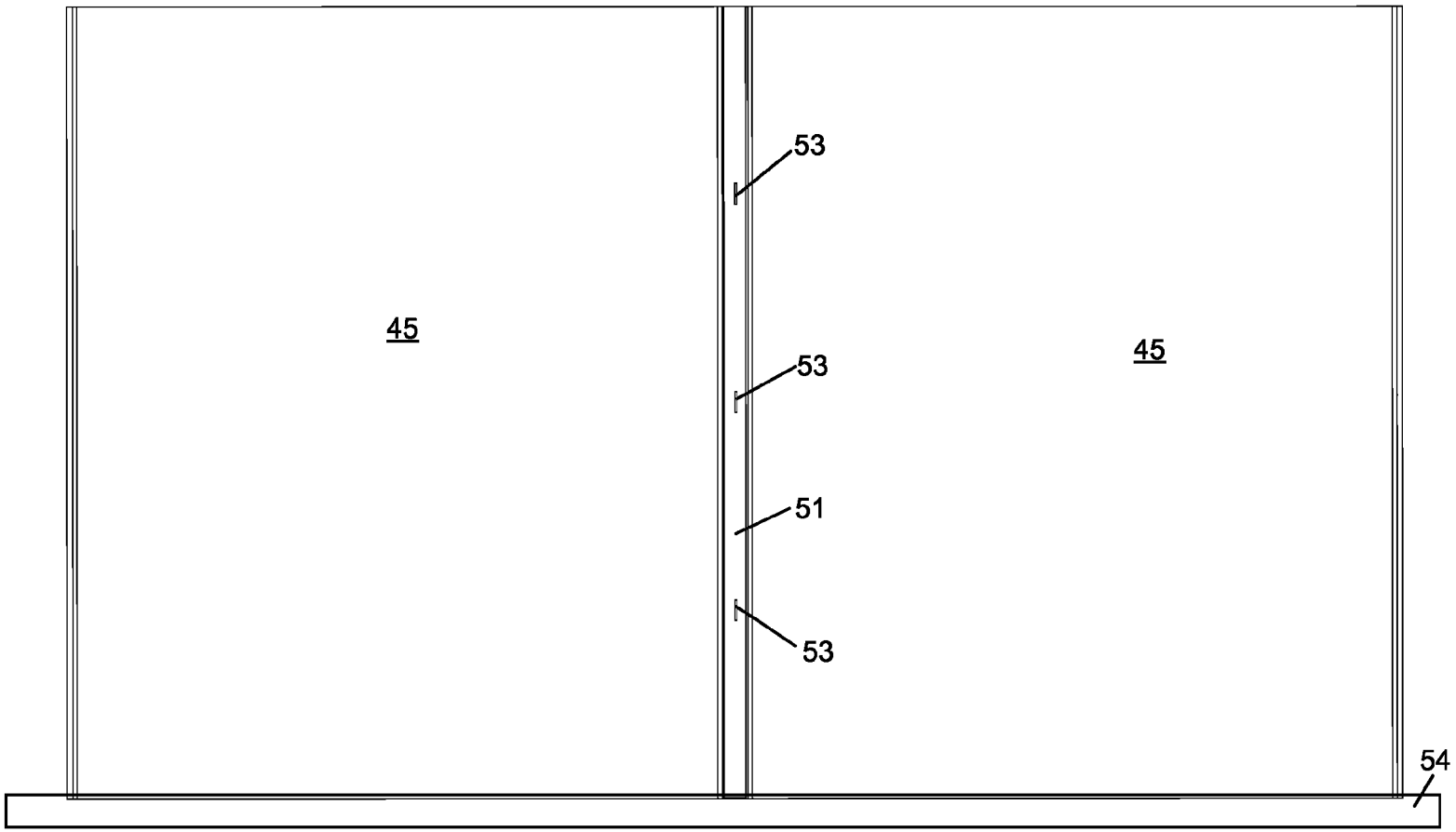
FIG. 24 is an interior view of liners and a post with logistic slots in a logistic span.

The post includes a pocket 75 with ridges 80 adapted to secure the outer sheets 15 in the pocket 75. A first wall 85 and a shortened second wall 91 run adjacent to the outer sheets 15 or outer panels and include small outward protrusions 95 that extend from the walls toward the outer sheets. Adhesive may be placed between the small outward protrusions to help secure the post to the outer sheets. An outward span protrusion 52 or first partition extends outwards from the logistics span 51 or interior wall towards the outer sheets 15. A third wall 92 is secured to the outermost portion of the span protrusion and runs adjacent to the outer sheets 15. In the illustrated example, the inward protrusions 60 of the post include inner bulbous areas 61 and outer bulbous areas between a thin span 63. The bulbous areas (61 and 62) present larger surface areas for the inner liners 20 and outer sheets 15 to contact. The larger surface area spreads out the forces exerted by the post on the sheets and decreases the likelihood that a post would damage a sheet. The thin span 63 between the bulbous regions reduces the amount of material needed to construct the post and also reduces the weight of the post. FIG. 23 shows a logistic slot 53 in the logistic span 51, and FIG. 24 illustrates multiple logistic slots 53 in a single logistic span 51. The sidewall construction shown in FIG. 24 is part of a cargo container and extends up from the floor 54. The sidewall bounds an interior storage space.

Figure 25:
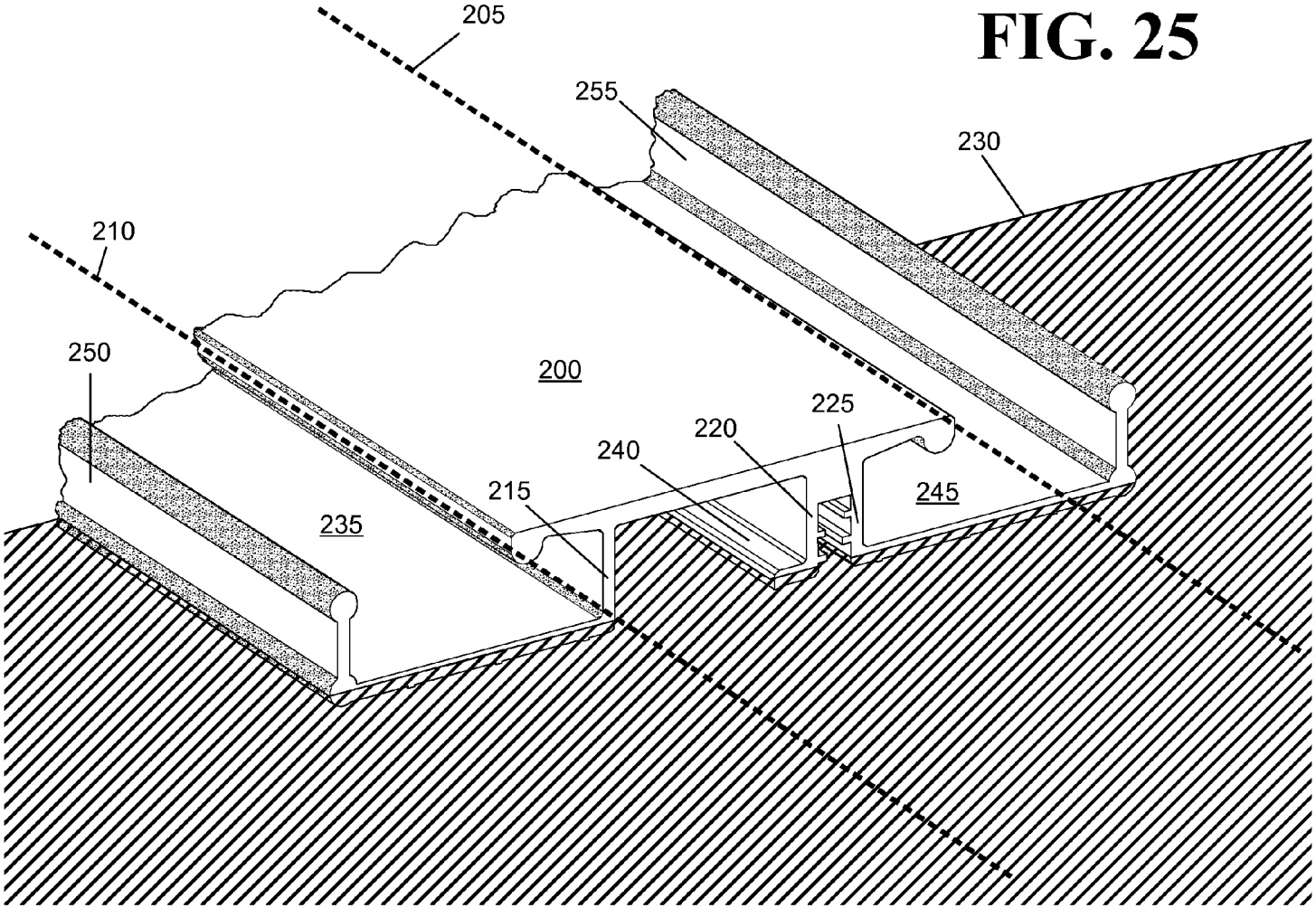
FIG. 25 is a perspective view of a sidewall post with an interior wall horizontally bounded by two vertical edges and partitions extending to a geometric plane from the interior wall.

FIG. 25 shows a sidewall construction with an interior wall 200 extending between and horizontally bounded by a first vertical edge 205 and a second vertical edge 210. The vertical edges extend upwardly from the floor of the cargo container. A first partition 215, a second partition 220, and a third partition 225 extend perpendicularly from the interior wall 200 to a geometric plane 230. A first wall 235 extends from the first partition 215 away from the second partition 220 and parallel to the interior wall 200. A second wall 240 extends from the second partition 220 towards the first partition and parallel to the interior wall 200. A third wall 245 extends from the third partition 225 away from the second partition 220 and parallel to the interior wall 200. A fourth partition 250 extends perpendicularly inwardly from the first wall 235 and a fifth partition 255 extends perpendicularly inward from the third partition. The first, second and third partitions are all distant from both the first vertical edge 205 and the second vertical edge 210 of the interior wall 200.

Figure 26:
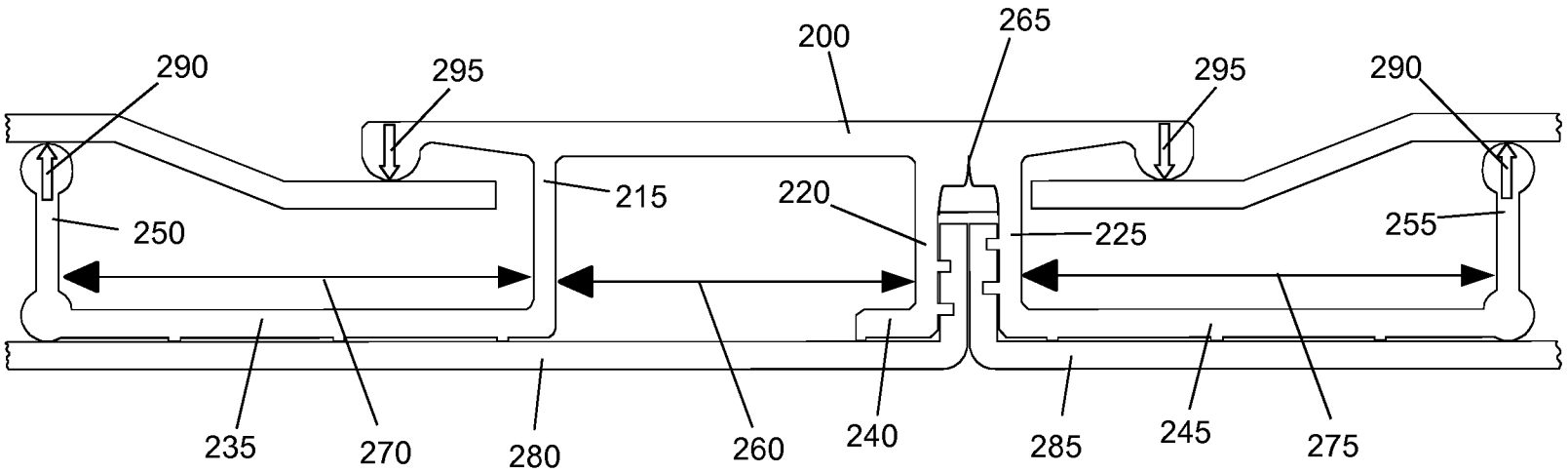
FIG. 26 is a side view of a sidewall construction highlighting the distances between partitions.

FIG. 26 illustrates a sidewall with a first partition 215 separated from a second partition 220 by a first distance 260. The third partition 225 is separated from the second by a second distance 265, and the second distance 265 is substantially smaller than the first distance 260. The first partition 215 is separated from the fourth partition 250 by a third distance 270 and the third partition 225 is separated from the fifth partition 255 by a fourth distance 275. The third distance 270 and the fourth distance 275 are substantially equal. In the illustrated example, a first outer panel 280 is adhesively bound to both the first wall 235 and the second wall 240, while a second outer panel 285 is adhesively bound to the third wall 245. Each of the first and second outer panels includes a portion located and secured between the second partition 220 and the third partition 225. Removable panels are secured in the sidewall by the fourth and fifth partitions exerting inward forces 290 on the removable panels while the interior wall is exerting outward forces 295 upon the removable panels.

The materials used in the side wall construction may include, but are not limited to, wood, metals, carbon fibers, and polymers. The individual components may be of a uniform or variant composition. A protective coating may be added to any material to protect it from road spray and general corrosion.

The inventors contemplate several alterations and improvements to the disclosed invention. Other alterations, variations, and combinations are possible that fall within the scope of the present invention. Although the preferred embodiment of the present invention has been described, those skilled in the art will recognize other modifications that may be made that would nonetheless fall within the scope of the present invention.

I claim:

1. A cargo container having an interior for the storage and transport of cargo, a floor, and a sidewall structure extending upwardly from the floor and bounding an interior cargo storage space, the sidewall structure comprising:

an interior wall horizontally bounded by a first vertical edge and a second vertical edge;

a first partition, a second partition and a third partition, the second partition located between the first and third partitions, each of the first partition, the second partition and the third partition directly contacting and outwardly extending from the interior wall distant from both the first vertical edge and the second vertical edge; and a first wall directly contacting and extending from the first partition and a second wall directly contacting and extending from the third partition, each of the first and second walls extending away from the second partition, parallel to the interior wall.

2. The cargo container of claim 1 further comprising the sidewall structure having a fourth partition inwardly extending from the first wall and a fifth partition inwardly extending from the second wall.

3. The cargo container of claim 2 further comprising a removable panel secured between the interior wall and the fourth partition, the fourth partition exerting an inward force upon the removable panel and the interior wall exerting an outward force upon the removable panel.

4. The cargo container of claim 1 further comprising a first exterior panel adhesively secured to the first wall;

a second exterior panel adhesively secured to the second wall;

both the first partition and the second partition contacting the first exterior panel, the third partition contacting the second exterior panel; and each of the first exterior panel and the second exterior panel having a portion secured directly between the second partition and the third partition.

5. The cargo container of claim 4 further comprising the interior wall having a logistic opening between the first partition and the second partition.

6. The cargo container of claim 1 wherein both the first and second walls extend through a geometric plane parallel to the interior wall; and the second partition extends from the interior wall to the geometric plane.

7. The cargo container of claim 6 further comprising the first partition separated from the second partition by a first distance in the geometric plane;

the second partition separated from the third partition by a second distance in the geometric plane; and the first distance being substantially greater than the second distance.

8. The cargo container of claim 7 further comprising a fourth partition inwardly extending from the from the first wall and a fifth partition inwardly extending from the second wall;

the fourth partition separated from the first partition by a third distance;

the fifth partition separated from the third partition by a fourth distance;

the third distance being equal to the fourth distance.

9. The cargo container of claim 7 further comprising a third wall directly contacting and extending from the second partition, through the geometric plane, towards the first wall.

10. The cargo container of claim 9 further comprising a first exterior panel adhesively secured to both the first wall and the third wall;

a second exterior panel adhesively secured to the second wall; and each of the first exterior panel and the second exterior panel having a portion secured directly between the second partition and the third partition.

11. The cargo container of claim 10 further comprising a fourth partition inwardly extending from the from the first wall and a fifth partition inwardly extending from the second wall;

a removable panel secured between the interior wall and the fourth partition, the fourth partition exerting an inward force upon the removable panel and the interior wall exerting an outward force upon the removable panel; and a first ridge extending from the second partition towards the third partition.

12. The cargo container of claim 1 further comprising a first ridge extending from the second partition towards the third partition; and a second ridge extending from the third partition towards the second partition.

13. A cargo container having an interior for the storage and transport of cargo, a floor, and a sidewall structure extending upwardly from the floor and bounding an interior cargo storage space, the sidewall structure comprising:

an interior wall horizontally bounded by a first vertical edge and a second vertical edge;

a first partition, a second partition and a third partition, each of the first partition, the second partition and the third partition directly contacting and outwardly extending from the interior wall distant from both the first vertical edge and the second vertical edge;

a first wall extending from the first partition, parallel to the interior wall, away from the second partition;

a first exterior panel adhesively secured to the first wall and having a portion secured directly between the second partition and the third partition.

14. The cargo container of claim 13 further comprising the sidewall having a fourth partition inwardly extending from the first wall;

the second partition contacting the first exterior panel; and a removable panel secured between the interior wall and the fourth partition, the fourth partition exerting an inward force upon the removable panel and the interior wall exerting an outward force upon the removable panel.

15. The cargo container of claim 14 further comprising the interior wall having a logistic opening between the first partition and the second partition.

16. The cargo container of claim 13 further comprising the sidewall having a first ridge extending from the second partition towards the third partition, the first ridge interconnecting with the first exterior panel.

17. The cargo container of claim 13 further comprising the first wall extending through a geometric plane parallel to the interior wall;

wherein both the second partition and the third partition extend form the interior wall to the geometric plane; and a second exterior panel having a portion secured directly between the second partition and the third partition.

18. The cargo container of claim 17 further comprising a first ridge extending from the second partition towards the third partition, the first ridge interconnecting with the first exterior panel; and a second ridge extending from the third partition towards the second partition, the second ridge interconnecting with the second exterior panel.

19. The cargo container of claim 13 further comprising each partition outwardly extending from the interior wall perpendicular to the interior wall.

20. The cargo container of claim 13 further comprising a third wall extending from the second partition, parallel to the interior wall, towards the first partition;

the first exterior panel adhesively secured to the second wall.

* * * * *